US011692397B2

(12) United States Patent
Feng et al.

(10) Patent No.: US 11,692,397 B2
(45) Date of Patent: Jul. 4, 2023

(54) DIRECTIONAL WELL TRAJECTORY CONTROL METHOD BASED ON DRILL PIPE DRIVE

(71) Applicant: YANGTZE UNIVERSITY, Jingzhou (CN)

(72) Inventors: Ding Feng, Jingzhou (CN); Hong Zhang, Jingzhou (CN); Peng Wang, Jingzhou (CN); Lei Shi, Jingzhou (CN); Deshu Lin, Jingzhou (CN)

(73) Assignee: YANGTZE UNIVERSITY, Jingzhou (CN)

( * ) Notice: Subject to any disclaimer, the term of this patent is extended or adjusted under 35 U.S.C. 154(b) by 73 days.

(21) Appl. No.: 17/241,591

(22) Filed: Apr. 27, 2021

(65) Prior Publication Data

US 2022/0112769 A1 Apr. 14, 2022

(30) Foreign Application Priority Data

Oct. 14, 2020 (CN) ..... 202011097145.X

(51) Int. Cl.

| | |
|---|---|
| ***E21B 7/04*** | (2006.01) |
| ***E21B 44/02*** | (2006.01) |
| ***E21B 49/00*** | (2006.01) |

(52) U.S. Cl.

CPC ..... *E21B 7/04* (2013.01); *E21B 44/02* (2013.01); *E21B 49/003* (2013.01)

(58) Field of Classification Search

CPC ..... E21B 44/02; E21B 49/003; E21B 7/04; E21B 7/06

See application file for complete search history.

(56) References Cited

U.S. PATENT DOCUMENTS

2016/0326857 A1* 11/2016 Deolalikar ..... G01P 3/00
2016/0356089 A1* 12/2016 Nanayakkara ..... E21B 4/006

* cited by examiner

*Primary Examiner* — Dany E Akakpo
(74) *Attorney, Agent, or Firm* — WPAT, P.C

(57) ABSTRACT

Disclosed is a directional well trajectory control method based on drill pipe drive, the method including the following steps: parameters down-transmission, determining the offset vector, closed loop control of eccentric ring rotation angle, and well parameter closed-loop control; this method can achieve three-dimensional well trajectory control without frequent trips during drilling operations, and has a high penetration rate, good wellbore cleaning effect, well trajectory control accuracy, high flexibility, low tripping times, high borehole quality, high safety, etc., which is suitable for the development of special process wells such as medium-deep wells, ultra-deep wells, ultra-thin oil layer horizontal wells and unconventional oil and gas wells in China's complex oil and gas reservoirs. This method can also achieve precise control of well trajectory, and overcome the shortcomings of existing control methods that cannot achieve closed-loop control and cannot remove interference signals.

1 Claim, 11 Drawing Sheets

DIRECTIONAL WELL TRAJECTORY CONTROL METHOD BASED ON DRILL PIPE DRIVE

FIELD OF THE DISCLOSURE

The disclosure relates to directional well trajectory control method based on drill pipe drive.

BACKGROUND

Due to continuous exploitation, the difficulty of oil exploitation is also increasing step by step. Complex wells such as extended-reach wells, ultra-thin oil layer horizontal wells, and directional wells are taking up an increasing proportion of oil and gas exploration and exploitation. On the other hand, the increase of the exploitation difficulty has also led to a significant increase in costs. Traditional drilling tools can no longer meet the requirements. Therefore, there is an urgent need for new drilling tools that can not only meet the needs of the exploitation of these complex wells, but also reduce the exploitation costs.

Directional well trajectory control tools based on drill pipe drive use the rotation of the drill pipe as the driving force of the bias mechanism. Under the action of the bias mechanism, the tool spindle is forced to produce an offset, which causes the drill to have an inclination with the axis of the borehole to perform directional drilling. Directional well trajectory control tools include an eccentric mechanism and a deceleration device, an electromagnetic clutch, a sensor and a controller connected to the eccentric mechanism, the biasing power of well trajectory control tools is provided by a drill pipe. The eccentric mechanism is composed of an inner ring and an outer ring. The inner ring is nested in the inner hole of the outer ring, and the main shaft is nested in the inner hole of the inner ring. The matched well trajectory control method is to down-transmit control signals to the controller through drilling fluid pulses, so that the controller controls the action of the electromagnetic clutch to control the actions of the inner ring and the outer ring of the eccentric mechanism, thereby realizing deflection, which can realize three-dimensional well trajectory control during drilling operations without frequent trips. However, the existing control method has defects in the control process, such as the inability in close-loop control, the inability to remove interference signals, etc., and often cannot accurately control well trajectory. Well trajectory has certain deviations, so it is necessary to improve the existing control method to enable precise control of well trajectory.

SUMMARY

The directional well trajectory control method based on the drill pipe drive provided by this disclosure can accurately control the well trajectory through the reasonable setting of the decoding method, the bias vector calculation method, and the sensor placement position. Through the closed loop of the deflection angle and the measured deflection angle, the well trajectory can be further accurately controlled to solve the problem that the existing control method cannot accurately control the well trajectory.

A directional well trajectory control method based on drill pipe drive, including the following steps:

1) Parameters Down-Transmission a) The wellbore parameters are coded by the method of dynamic incremental coding of steering parameters, after the coding is completed, the wellbore parameters are down-transmitted to the tool controller through drilling fluid pulses;

b) After the tool controller receives the drilling fluid pulse signal, it decodes the pulse signal through initial threshold determination, peak detection, and threshold update;

2) Determining the Offset Vector a) According to the detection value of the attitude sensor and the decoded well parameters, calculating the tool face angle and offset value;

b) Calculating the rotation angle of the eccentric ring according to the offset value;

3) Closed Loop Control of Eccentric Ring Rotation Angle a) Measuring the output of the eccentric ring angle through the angle sensor, and controlling the opening and closing of the electromagnetic clutch according to the difference between the preset angle and the angle output, so that the eccentric ring rotates to the rotation angle of the eccentric ring in step 2) for closed-loop control of the rotation angle;

4) Well Parameter Closed-Loop Control a) The actual well inclination, azimuth, and tool face angle are measured by sensors, and then comparing the actual well inclination, azimuth, and tool face angle with the preset wellbore parameters;

b) Repeating steps 2) and 3) according to the comparison results to compensate the well trajectory and performing closed-loop control of the well parameters.

The directional well trajectory control method based on drill pipe drive can achieve three-dimensional well trajectory control without frequent trips during drilling operations, and has a high penetration rate, good wellbore cleaning effect, well trajectory control accuracy, high flexibility, low tripping times, high borehole quality, high safety, etc., which is suitable for the development of special process wells such as medium-deep wells, ultra-deep wells, ultra-thin oil layer horizontal wells and unconventional oil and gas wells in China's complex oil and gas reservoirs. This method can also achieve precise control of well trajectory, and overcome the shortcomings of existing control methods that cannot achieve closed-loop control and cannot remove interference signals.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the figures.

DETAILED DESCRIPTION OF PREFERRED EMBODIMENTS

Embodiment is provided below to further explain the method provided by this disclosure.

Figure 1:
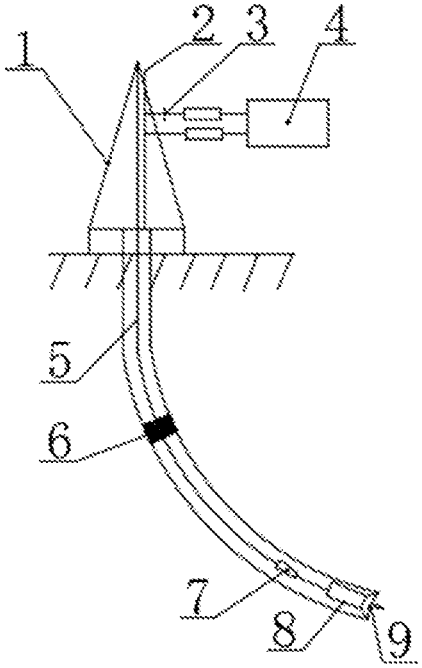
FIG. 1 is a schematic diagram of this disclosure in a guided state.
Figure 2:
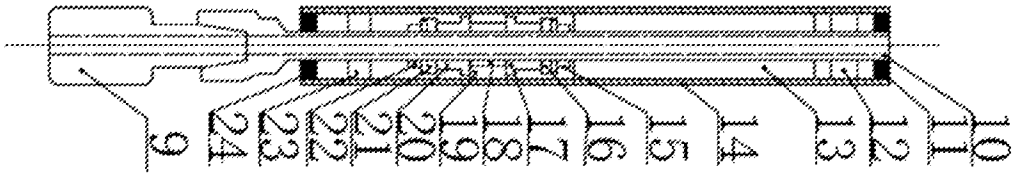
FIG. 2 is a schematic diagram of the structure of a directional well trajectory control tool based on drill pipe drive.
Figure 3:
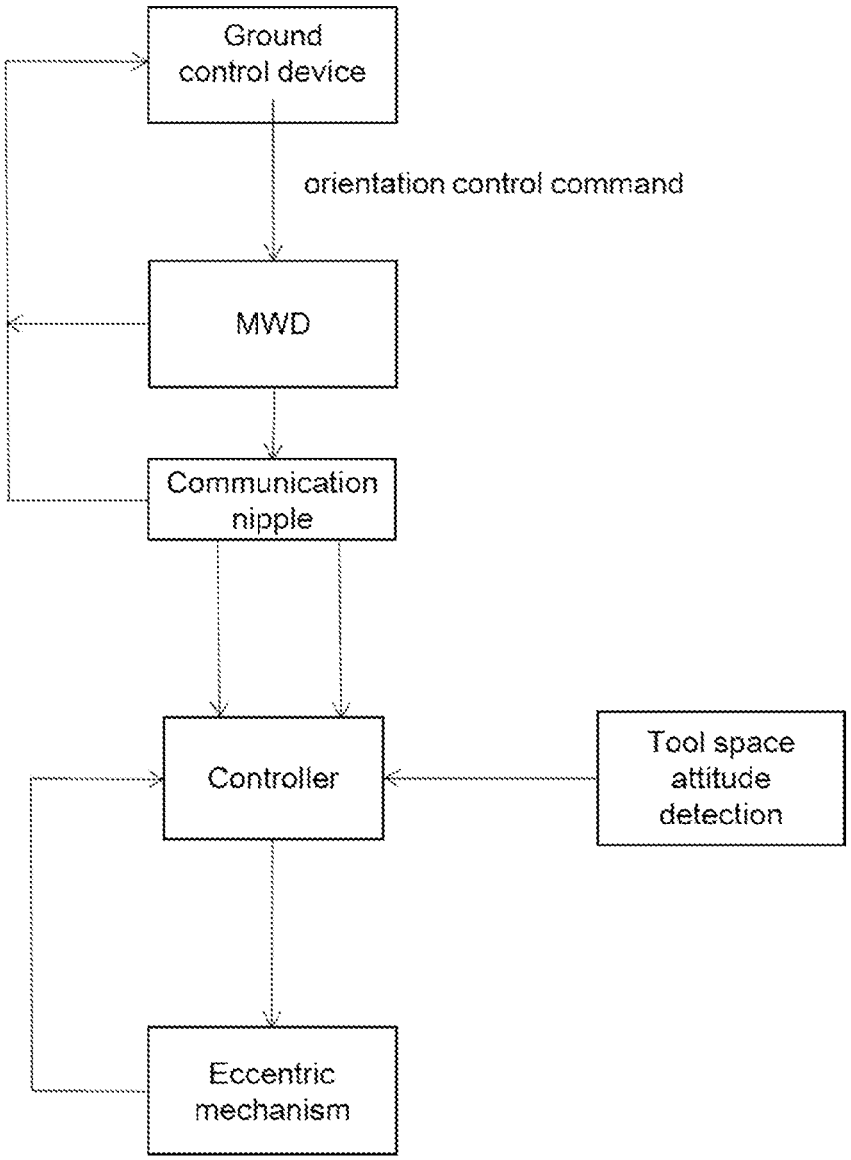
FIG. 3 is a schematic diagram of the overall control scheme of this disclosure.

A directional well trajectory control method based on drill pipe drive, including the following steps:

The overall control scheme of the directional well trajectory control is: the ground terminal includes a data acquisition and transmission unit, a ground calculation and analysis simulation center, and an instruction down-transmission unit; according to the data at the preset point and the current point, the ground terminal performs calculations, the orientation control command is down-transmitted to the MWD. The down-transmission of the well parameters mainly includes encoding and decoding, mainly adopts the dynamic incremental coding method of the guidance parameter; then the command is down-transmitted to the tool controller through the communication subsection, and the tool controller is based on the instruction and the measurement result of the attitude sensor to control the eccentric mechanism of the well trajectory control tool 9 to make the eccentric ring reach the specified position; the eccentric ring position sensor feeds back the current position and angle of the eccentric ring to the controller, and the controller compares the difference with the predetermined position values, makes the eccentric ring rotate again, and repeats until the deviation is within the required range; the drill pipe in the wellbore drives the drill to perform drilling, and at the same time provides power for the bias mechanism of the well trajectory control tool 9; the controller of the well trajectory control tool 9 is based on the control commands down-transmitted from the ground and the measurement data of the downhole sensors to control the well trajectory control tool to achieve guidance (referring to FIG. 1).

The well trajectory control tool includes a mandrel 10, an upper dynamic sealing device 11, an upper cantilever bearing 12, an inclinometer puppet 13, an upper coupling 15, an outer ring electromagnetic clutch 16, an outer ring harmonic drive device 17, an inner ring 18, an outer ring 19, an inner ring harmonic drive device 20, an inner ring electromagnetic clutch 21, a lower end coupling 22, a lower end ball bearing 23, a lower end dynamic sealing device 24 and a drill 9; the upper end of the drill string is connected with the drill pipe 5, and the lower end is connected with the mandrel 10; the mandrel 10 is a hollow rotating shaft, which is the power source of the entire tool. The power of the mandrel 10 is provided by the upper drill pipe 5; the upper dynamic sealing device 11 is installed at the uppermost end of the tool; the lower end of the upper coupling 15 is installed with the outer ring electromagnetic clutch 16, the outer ring harmonic drive device 17, and the eccentric mechanism in sequence; the installation positions of the inner ring harmonic drive device 20, the inner ring electromagnetic clutch 21 and the lower end coupling 22 are symmetric about eccentric mechanism with respect to the installation positions of outer ring harmonic drive device 17, the outer ring electromagnetic clutch 16 and the upper coupling 15, and their connection forms are the same; the lower end ball bearing 23 and the lower end dynamic sealing device 24 are installed at the bottom of the tool.

The drilling steering parameter commands is down-transmitted along the drill string through drilling fluid pulses to the communication nipple at the bottom hole drill; the drilling fluid is modulated into pulse waves to flow in the drill string through coding and modulation, the bottom hole receiving end needs to use the corresponding decoding algorithm for decoding, so that the drilling fluid pulse information can be converted into steering commands for execution.

Incremental Coding Method for Down-Transmitted Parameters

Due to the limited data value transmitted by the combined encoding method, the efficiency of data transmission is low, and there is no check code at the receiving end of the data. In drilling directional control, it is difficult to better meet the requirements of precise directional drilling. Therefore, the disclosure proposes a dynamic incremental value encoding method for directional drilling parameters to complete the encoding transmission process of the directional drilling parameters. According to the preset incremental positive and negative sign s and the difference relative to the previous overall data Δd, based on the previous data transmission, the subsequent data only needs to be transmitted $\Delta d_s$, which can be calculated and obtained through the formula (2-1).

$$\Delta d_s = s \times \Delta d \tag{2-1}$$

After receiving the parameters, the specific values can be calculated by substituting the last calculated value d1 and the incremental data value $\Delta d_s$ into the formula (2-1).

$$d_2 = d_1 + \Delta d_s \tag{2-2}$$

In the above formula (2-2), the incremental positive and negative sign s is set by the ground control unit that transmits the information. The use of dynamic incremental data is mainly to solve a large number of repeated data transmissions and reduce the length of pulse time occupied by data; the use of dynamic incremental value to transmit data can effectively reduce the amount of data transmission and improve the efficiency of the transmission system.

Figure 4:
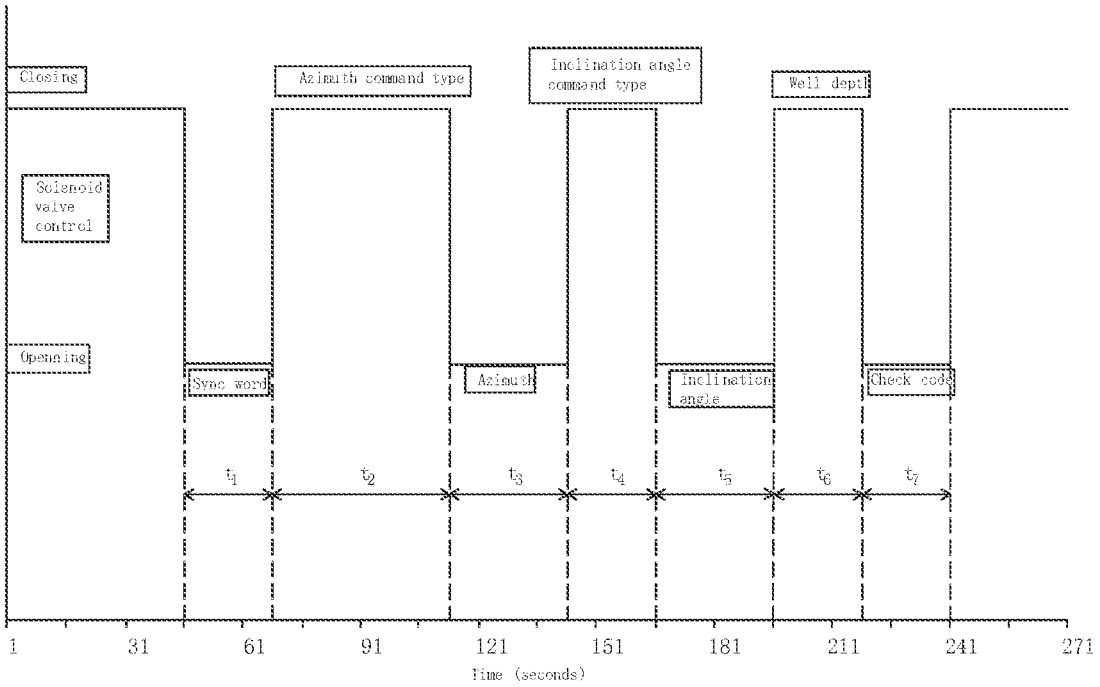
FIG. 4 is a schematic diagram of the time sequence of the incremental coding of wellbore parameters of this disclosure.

Specifically: the ground down-transmission parameters include well depth, well inclination, and azimuth, and the down-transmission data packets include: synchronization word, command type, azimuth, inclination, well depth and inspection code, on the ground, the data package is coded according to the coding rules in Table 1 with the multiple of drilling fluid unit pulse time $T_p$. After encoding, the duration of 7 pulses can be obtained, including $t_1$, $t_2$, $t_3$, $t_4$, $t_5$, $t_6$, $t_7$, the low pulse duration $t_1$ is the length of the synchronization word, the high pulse duration $t_2$ represents the azimuth command type, and the low pulse The duration $t_3$ represents the azimuth value, the high pulse duration $t_4$ represents the inclination angle command type, the low pulse duration $t_5$ represents the inclination angle value, the high pulse duration $t_6$ represents the well depth, and the low pulse duration $t_7$ represents the check code. As shown in Table 1, $\phi$ represents the transmitted azimuth angle parameter; $\phi_1$ is the last azimuth angle value; $\beta$ represents the transmitted well deviation angle parameter; $\beta_1$ is the last well deviation angle value; setting the maximum well depth increment 30 meters, and calculating the footage value directly through the pulse time. $\Delta L$ represents the footage value in meters. It should be noted that the drilling fluid unit pulse time $T_p$ needs to be selected according to the characteristics of the drilling fluid. If the selected time is short, the change rate of the drilling fluid flow rate cannot match the command change rate, resulting in the inability to effectively down-transmit the data (referring to FIG. 4).

Decoding Method for Down-Transmitting Parameters

Figure 5:
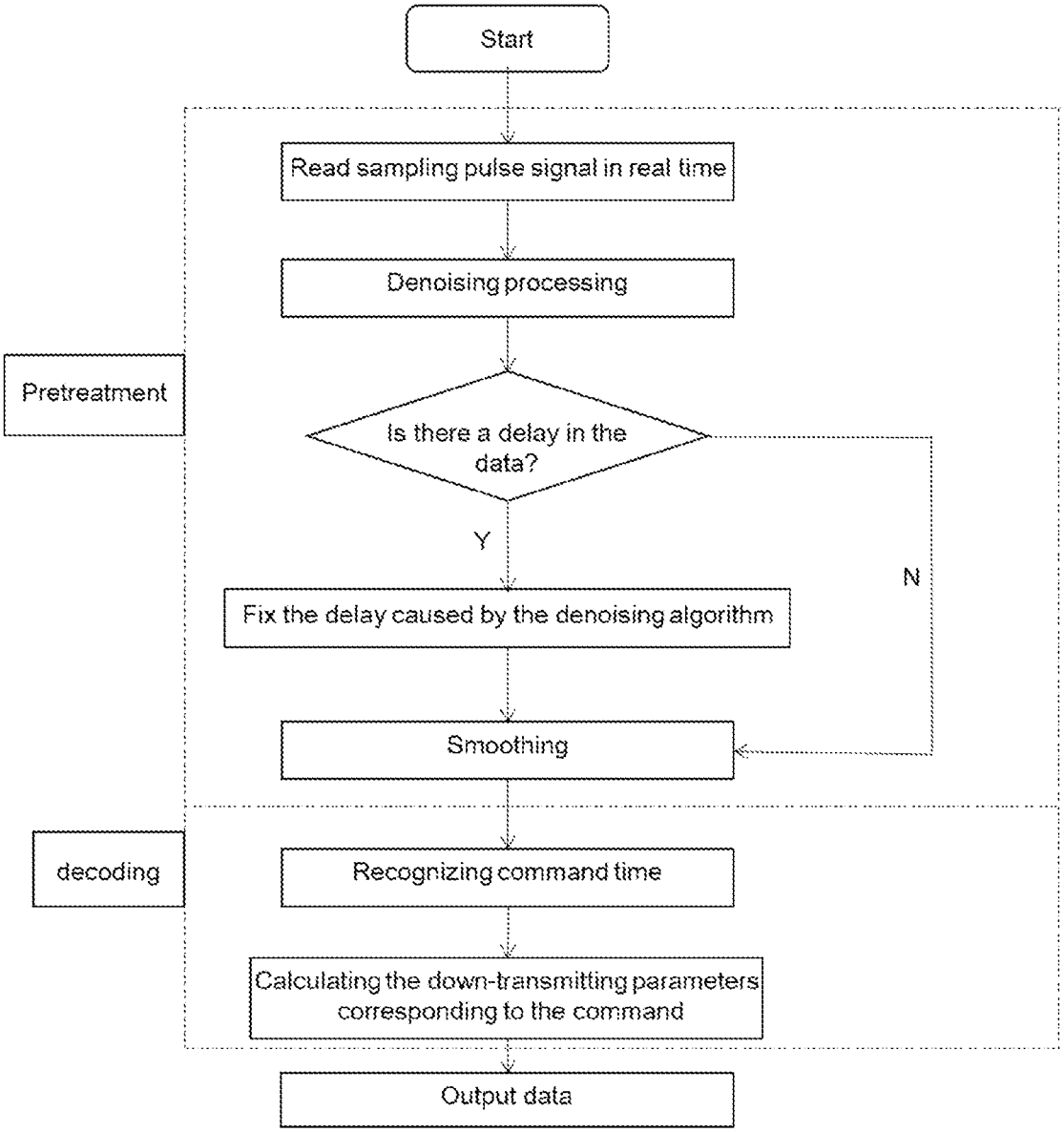
FIG. 5 is a schematic diagram of the decoding process of parameters down-transmission according to this disclosure.

The core of decoding is to identify the duration of a pulse, so it is necessary to find out the time points of the beginning and end of the pulse; and the pulse signal received by the bottom hole equipment contains a lot of interference information, and the pulse signal cannot be directly identified, so it is necessary to check the pulse signal. The down-transmission signal is preprocessed, and then the peak value of the incrementally coded drilling fluid pulse signal is identified, so as to determine the beginning and end of the pulse, and then determining the pulse duration, and finally decoding the ground transmission instruction through the encoding rule; the process of down-transmitting parameters decoding mainly includes pulse signal preprocessing and decoding. The first step of the preprocessing process is reading the real-time sampled pulse signal, and then performs denoising processing on it to see if there is a delay in the data. If there is no delay, smoothing is performed; If there is a delay, it is needed to repair the delay caused by denoising first, and then perform smoothing; the signal after preprocessing is a standard pulse signal, identifying the peak value combined with the dynamic differential threshold method, determining the pulse duration, and finally calculating the corresponding down-transmitting parameters according to the instruction time to complete the decoding (FIG. 5).

According to the characteristics of the actual drilling fluid wave, the peak value of the drilling fluid pulse signal is dynamically extracted, and the method of symbolized signal approximate matching is applied according to the threshold value in the extraction process to detect the interference section of the drilling fluid pulse signal, which can effectively improve the peak value of the drilling fluid wave. The specific process of detection efficiency can be divided into initial threshold determination, drilling fluid pulse wave peak detection and threshold update.

Initial threshold determination: The bottom hole flow sensor is grouped by time period (for example: 5 groups) to detect the drilling fluid flow signal. By calculating the value of the largest difference in each group of data, removing the maximum and minimum values, the retained data is recorded as $[d_1, d_2, d_3]$, where $\overline{D}$ is used to represent its arithmetic mean, the calculation of the upper limit of the initial difference threshold is $Th_1=0.8\overline{D}$ the calculation of the lower limit of the initial difference threshold is $Th_2=0.3\overline{D}$; the array of the upper limit of the initial difference threshold is $TH_1=[0.8\overline{D},0.8\overline{D},0.8\overline{D}]$, and the array of the lower limit of the initial difference threshold is $TH_1=[0.3\overline{D},0.3\overline{D},0.3\overline{D}]$; respectively traversing 5 groups of data to find the maximum amplitude of each group of data, removing the maximum and minimum values, and marking the retained data as $[a_1,a_2,a_3]$, where $\overline{A}$ represents its arithmetic mean; the upper limit of the initial amplitude threshold is calculated as $Th_3=1.3\overline{A}$: The amplitude threshold lower limit is $Th_4=0.3\overline{A}$; the initial amplitude threshold upper limit array is $TH_3=[1.3\overline{A},1.3\overline{A},1.3\overline{A}]$, the initial amplitude threshold lower limit array is $TH_4=[0.3\overline{A},0.3\overline{A},0.3\overline{A}]$; identifying the peak value through the initial threshold: the dynamic difference threshold and amplitude threshold are obtained by continuous iterative solution with the purpose to limit the amplitude of the uneven drilling fluid pulse signal curve to a straight line, and the amplitude exceeding or lower than this straight line will be discarded to facilitate the identifying of peaks and valleys.

Peak value identifying: assuming that any three consecutive points of the drilling fluid pulse signal curve are $f_i$, $f_{i+1}$, $f_{i+2}$; through $f_{i+1}-f_i>Th_1$ and $f_{i+2}-f_{i+1}>Th_1$, it can be judged whether $f_{i+1}$ is on the falling edge of the drilling fluid pulse; through $f_{i+1}-f_i>Th_1$ and $f_{i+2}-f_{i+1}>Th_1$, it can be judged whether $f_{i+1}$ is on the rising edge of the drilling fluid pulse; combined with the previous falling edge and rising edge judgment, If $f_{i+1}$ satisfies $|f_{i+1}-f_i|<|Th_2|$ and $|f_{i+2}-f_{i+1}|<Th_2|$, that is, the characteristics of the peak value of the pulse data meeting the differential threshold, it can be judged that $f_{i+1}$ is in a certain point on the peak or trough of the drilling fluid pulse signal; at this point, a data point $f_{i+1}$ that meets the characteristics of the falling edge can be found, and then setting two consecutive points of $f_{i+1}$ as $f_{i+2}$ and $f_{i+3}$. If $|f_{i+1}|<|Th_2|$ and $|f_{i+3}-f_{i+2}|<|Th_2|$ are satisfied, $f_{i+2}$ may be the valley pulse value point, and its amplitude value is recorded as $\alpha_{new}$; adopting the amplitude threshold value to judge whether $f_{i+2}$ is the pulse valley point, the judgment condition is $|f_{i+3}-f_{i+2}|<|Th_2|$; if the judgment condition is met, then $f_{i+2}$ is the valley pulse value point, at this time, the lower limit array of the amplitude threshold needs to be updated to $TH_4=[0.3\overline{A},0.3\overline{A},a_{new}]$. At the same time, updating $Th_4=\overline{TH_4}$. If $f_{i+2}$ does not meet the judgment condition, you can continue to the next detection point, continuing to iterate the calculation according to the above process until the trough point is found; or when the calculation condition ends, the trough point is the last calculated value.

Threshold update: by continuously identifying new peaks and troughs of the drilling fluid pulse, the previous thresholds are replaced, and the next identifying is performed:

Firstly, supposing that any continuous three points $f_i$, $f_{i+1}$ and $f_{i+2}$ meet the characteristics of the pulse data falling of the differential threshold; calculating the maximum difference between $f_{i+1}$ and $f_{i+2}$, the intermediate result is $d_{new}$, and the amplitude value of $f_{i+2}$ is recorded as $a_{new}$; because it is currently on the falling edge of the pulse, it is necessary to update the lower limit array of the differential threshold to $TH_2=[0.3\overline{D},0.3\overline{D},d_{new}]$ and at the same time updating $Th_2=\overline{TH_2}$; updating the lower limit array of the amplitude threshold to $TH_4=[0.3\overline{A},0.3\overline{A},a_{new}]$, at the same time updating $Th_4=\overline{TH_4}$.

Secondly, supposing that any continuous three points $f_i$, $f_{i+1}$ and $f_{i+2}$ meet the characteristics of the pulse data rising of the differential threshold; calculating the maximum difference between $f_{i+1}$ and $f_{i+2}$ the intermediate result is $d_{new}$, and the amplitude value of $f_{i+2}$ is recorded as $a_{new}$; because it is currently on the rising edge of the pulse, it is necessary to update the lower limit array of the differential threshold to $TH_1=[0.8\overline{D},0.8\overline{D},d_{new}]$ at the same time updating $Th_1=\overline{TH_1}$; updating the lower limit array of the amplitude threshold to $TH_3=[1.3\overline{A},1.3\overline{A},a_{new}]$, at the same time updating $Th_3=\overline{TH_3}$. Due to the change of the drilling depth during the drilling process, the pressure will fluctuate, and updating the threshold value continuously according to the situation of different formations; the dynamic threshold method is adopted to analyze the amplitude value of the interference signal, and dynamically correcting the amplitude value of the interference signal, which can ensure that the drilling fluid pulse communication is more stable; after the peak value is identified, calculating various borehole parameters using Table 1 through the various durations of the code.

TABLE 1

Dynamic incremental instruction coding format table

| Command name | Pluse type | Maximum pulse time (seconds) | Instruction description |
|---|---|---|---|
| Sync word | Low pulse | $T_p$ | $t_1 = T_p$ |
| Azimuth command type | High pulse | $3 \times T_p$ | $\begin{cases} 3\times T_p & \text{Full parameter} \quad \phi = (t_3 - T_p)\times 361/T_p \\ 2\times T_p & \text{Positive increment} \quad \phi = \phi_1 + (t_3 - T_p)\times 360/T_p \\ T_p & \text{Positive increment} \quad \phi = \phi_1 - (t_3 - T_p)\times 360/T_p \end{cases}$ |
| Azimuth | Low pulse | $2 \times T_p$ | Calculated from the value of $t_2$ and $t_3$ |
| Inclination angle command type | High pulse | $3 \times T_p$ | $\begin{cases} 3\times T_p & \text{Full parameter} \quad \beta t = (t_5 - T_p)\times 180/T_p \\ 2\times T_p & \text{Positive increment} \quad \beta t = Bt_1 + (t_6 - T_p)\times 180/T_p \\ T_p & \text{Negative increment} \quad \beta t = \beta t_1 - (t_5 - T_p)\times 180/T_p \end{cases}$ |
| Inclination angle | Low pulse | $2 \times T_p$ | Calculated from the value of $t_4$ and $t_6$ |
| Well depth | High pulse | $2 \times T_p$ | $\Delta L = (t_6 = T_p) \times 30/T_p$ |
| Check code | Low pulse | $2 \times T_p$ | $\begin{cases} T_p & (t_1 + t_2 + t_3 + t_4 + t_5 + t_6)/T_p \text{ is even} \\ 2\times T_p & (t_1 + t_2 + t_3 + t_4 + t_5 + t_6)/T_p \text{ is odd} \end{cases}$ |

Bias Vector Determination

Figure 6:
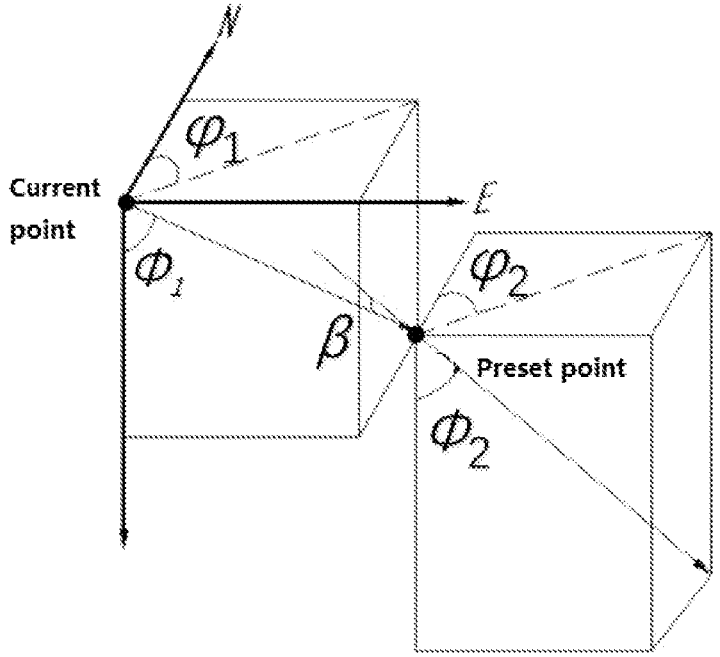
FIG. 6 is a schematic diagram of the positional relationship between the preset point and the current point of this disclosure.

According to the preset values in the attitude sensor and well parameters, the tool face angle and offset are calculated, specifically: the dogleg angle β can be calculated according to the spatial angle of the preset point and the current point, and the tool face angle α can be calculated, the calculation process (referring to FIG. 6) is:

$$\Delta\phi = \phi_1 - \phi_2 \Delta\varphi = \varphi_2 - \varphi_1 \varphi_m = \frac{\varphi_2 + \varphi_1}{2} \tag{3-1}$$

$$\beta = \sqrt{\Delta\varphi^2 + (\Delta\phi \sin\varphi_m)^2} \tag{3-2}$$

$$\alpha_{TF} = \arccos\left(\frac{\cos\varphi_1 \cos\beta - \cos\varphi_2}{\sin\beta \sin\varphi_1}\right) \tag{3-3}$$

In the formula, $\Delta\varphi$ is the difference between the azimuth angle of the preset point and the current point, $\Delta\varphi$ is the difference between the preset point and the current point well angle, $\varphi_m$ is the average value of the preset point and the current point well angle, β is the dog leg angle, $\alpha_{TF}$ is the general formula for calculating the tool face angle.

The range of the tool face angle is [0,2π], and the range of the inverse cosine function is [0,π], so the tool face angle needs to be selected according to the conditions:

If $-360° < \phi_2 - \phi_1 < -180°$, then $\alpha = \alpha_{TF}$

If $-180° < \phi_2 - \phi_1 < 0°$, then $\alpha = 2\pi - \alpha_{TF}$

If $0° < \phi_2 - \phi_1 < 180°$, then $\alpha = \alpha_{TF}$

If $-180° < \phi_2 - \phi_1 < 360°$, then $\alpha = 2\pi - \alpha_{TF}$

Then, according to the size of the directional well trajectory control tool driven by the drill pipe, the modulus of the combined bias vector, that is, the magnitude of the combined eccentricity, can be calculated.

$$|\vec{e}| = \frac{\beta(L^2 - L_1^2 - L_2^2)}{(L + L_1)} \tag{3-4}$$

In formula 3-4, $L_1$ is the distance from the upper bearing to the eccentric ring, $L_2$ is the distance from the lower bearing to the eccentric ring, L is the distance between the two bearings, $L = L_1 + L_2$, β is the dog leg angle, which is the angle between the drill axis and the tool axis, and |e| is the offset value.

Due to the friction between the tool shell and the rock formation, the shell rotates, causing the actual tool face angle to deviate from the calculated tool face angle. The deviation value is the shell rotation angle ψ. The tool face angle α can be obtained from the previous calculation. The shell rotation angle ψ is measured by the integrated three-axis gravity accelerometer module, and the actual tool face angle is θ=α+ψ.

Calculation of Eccentric Ring Angle

Figure 7:
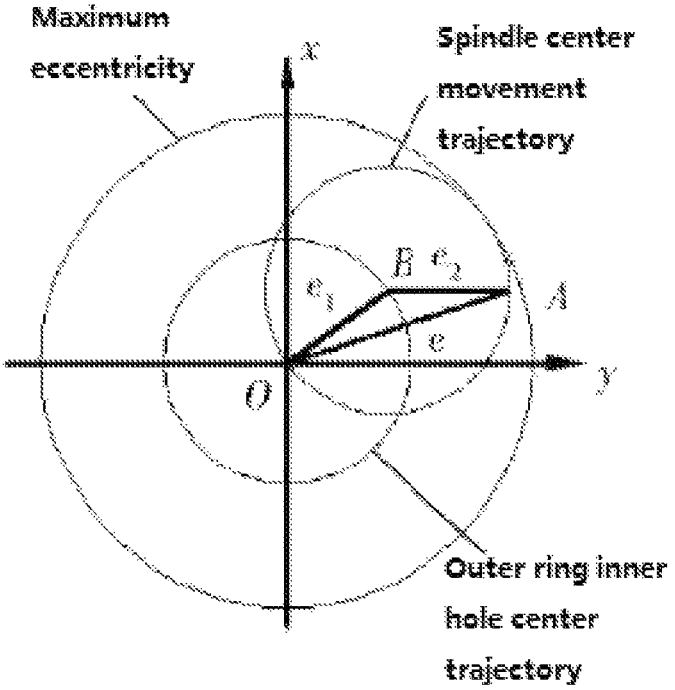
FIG. 7 is a schematic diagram of the eccentric displacement of the main shaft of this disclosure.
Figure 8:
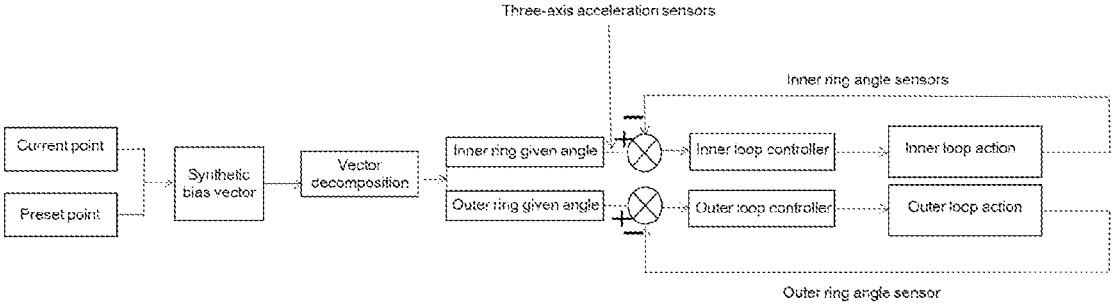
FIG. 8 is a schematic diagram of the well trajectory-oriented control algorithm of this disclosure.

The directional well trajectory control tool based on drill pipe drive can determine the offset vector according to the position parameters of the preset point and the current point when drilling, and decompose it into the offset vector on the inner eccentric ring and the outer eccentric ring, and finally transform it Into the rotation angle of the inner and outer eccentric ring. The schematic diagram of the eccentric displacement of the main shaft is shown in FIG. 7. The following relationship can be obtained by decomposing the total offset vector to the x-axis and y-axis:

$$e_x = e \cos\alpha = e_1 \cos\alpha_1 + e_2 \cos\alpha_2 \tag{4-1}$$

$$e_y = e \sin\alpha = e_1 \sin\alpha_1 + e_2 \sin\alpha_2 \tag{4-2}$$

o is the center of the shell, A is the center of the spindle, B is the center of the inner hole of the outer ring, $e_1$ is the eccentricity of the outer eccentric ring, $e_2$ is the eccentricity of the inner eccentric ring, and e is the total eccentricity of the eccentric ring group. In formulas 4-1 and 4-2, $e_x$ is the projection of e on the x-axis, and $e_y$ is the projection of e on the y-axis. The angles between $e_1$, $e_2$, e and the x-axis are $\alpha_1$, $\alpha_2$, and α (referring to FIG. 7).

After synthesizing the offset and position angle of the inner and outer eccentric ring, the following relationship can be obtained, that is, the expression of the current offset vector:

$$e = \sqrt{e_1^2 + e_2^2 + 2e_1e_2\cos(\alpha_2 - \alpha_1)} \tag{4-3}$$

$$\alpha = \arctan\frac{e_1\sin\alpha_1 + e_2\sin\alpha_2}{e_1\cos\alpha_1 + e_2\cos\alpha_2} \tag{4-4}$$

According to formulas 4-1, 4-2 and specific values of e, $e_1$, $e_2$ and $\alpha$, the position and angle expressions of the inner and outer eccentric rings can be obtained, as shown in formula 4-5.

$$\alpha_1 = \alpha \pm \arccos\left(\frac{e}{6}\right), \quad \alpha_2 = \alpha \mp \arccos\left(\frac{e}{6}\right) \tag{4-5}$$

It can be seen from formula 4-5 that two different solutions can be obtained according to the tool face angle and offset; to ensure that the target point can be reached in the shortest time, it is necessary to choose between these two solutions.

$$\theta_{20} = \text{arc tan } k_2 - \text{arctan } k_0 \tag{4-6}$$

$$\theta_{30} = \text{arc tan } k_3 - \text{arctan } k_0 \tag{4-7}$$

$$\theta_1 = \text{arc tan } k_4 - \text{arctan } k_1 \tag{4-8}$$

In formulas 4-6, 4-7, 4-8, $k_0$ is the slope of the line connecting the initial point of the inner hole center of the outer ring and the origin of the coordinate; $k_1$ is the slope of the line connecting the initial point of the spindle center and the origin of the coordinate; $k_4$ is the slope of the target point and the origin line; $k_2$ and $k_3$ are obtained by substituting $k_0$ and $k_1$ into the trajectory equation of the spindle center point; comparing the magnitude between $\theta_{20}$ and $\theta_{30}$, if the same value is positive, take the smaller value; if the same value is negative, take the value with larger absolute value; if one is positive and the other is negative, take the positive one; turn the drill pipe into the positive direction; and because the value range of arctanx is between 0-180°, if the $\theta$ ($\theta_{20}$ or $\theta_{30}$) selected before is positive, the outer eccentric ring is rotated by $\theta$ in the positive direction, and the inner eccentric ring is rotated by $\theta_1$ in the positive direction; if the previously selected $\theta$ is negative, the outer eccentric ring is rotated by $\theta$+360° in the positive direction, and the inner eccentric ring is rotated by $\theta_1$+360° in the positive direction.

Based on the decomposition of the synthetic offset vector, the inner and outer ring rotation angles are obtained. The well trajectory directional control algorithm obtains the tool face angle and offset from the synthetic offset vector, which can calculate the given angle of the inner and outer eccentric ring, Combined with the measured value of the three-axis acceleration sensor and the angle sensor, the difference between the predetermined value and the predetermined value can be obtained; after the inner and outer loops move, the angle sensor will feedback the measurement result to the tool controller again to get the difference again, making the inner and outer loops act according to the difference, and keep looping until the difference meets the requirements.

Closed Loop Control of Eccentric Loop Angle

Figure 9:
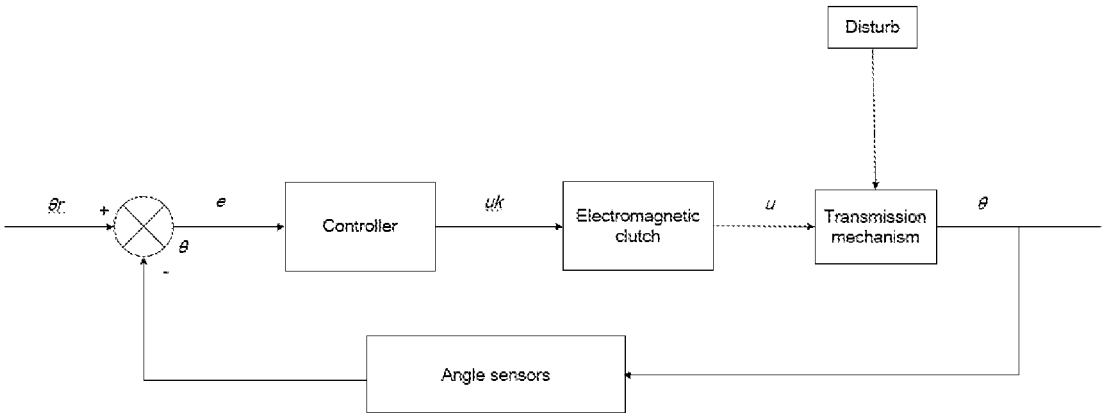
FIG. 9 is a schematic diagram of the closed-loop control principle of the rotation angle of the eccentric ring according to this disclosure.

Principle of Closed Loop Control of Eccentric Loop Angle $\theta_r$ is the preset angle input of the eccentric ring; e is the deviation; $u_k$ is the input of the electromagnetic clutch, which controls the opening and closing of the electromagnetic clutch; u is the output of the electromagnetic clutch; $\theta$ is the output of the eccentric ring angle, obtained by the angle sensor; According to the difference e between the preset angle $\theta_r$ and the angle output $\theta$, the controller controls the opening and closing of the electromagnetic clutch, and finally makes the eccentric ring act. The electromagnetic clutch used in this tool requires a starting voltage of +24v when starting, and only a maintenance voltage of 6v after starting. Based on the consideration of power consumption, PWM (Pulse Width Modulation) is used to control the switch of the electromagnetic clutch. The deviation between the angle detected by the sensor and the set angle is used as the control parameter of the eccentric ring rotation angle. The control accuracy of the entire closed-loop control is related to the detection accuracy, and the sensor detection accuracy is related to the performance and installation method of the sensor itself. In order to improve the detection accuracy, the sensor adopts the differential installation method, so that the detection accuracy is controlled at 1°, which lays the foundation for the closed-loop control of the eccentric ring rotation angle (referring to FIG. 9).

Algorithm for Electromagnetic Clutch Control

The working state of the electromagnetic clutch determines the rotation of the inner and outer rings. Therefore, under what circumstances the electromagnetic clutch is engaged and disconnected is of vital importance to the precise guidance of the entire system. The key factor determining the closing and opening of the electromagnetic clutch is the deviation e between the given angle and the measured value of the angle, but it is not necessary to engage the electromagnetic clutch as long as e>0. This requires a total of 5 conditions to determine the state of the electromagnetic clutch according to the difference e of the deviation and calculate the control of the battery clutch referring to Table 2.

TABLE 2

Electromagnetic clutch control algorithm

| Eccentric state | | Electromagnetic clutch control signal |
|---|---|---|
| E > 0 | $\lvert E\rvert > E_0$ | 1 (ON) |
| | $\lvert E\rvert < E_0$ | 0 (OFF) |
| E = 0 | | 0 (OFF) |
| E < 0 | $\lvert E\rvert < E_0$ | 0 (OFF) |
| | $\lvert E\rvert > E_0$ | 1 (ON) |

f

In the table, E=eccentric ring angle setting value—eccentric ring angle measured value; deviation zero band ($\pm E_0$) =actual allowable deviation range value (based on experience, artificially set).

Sensors Placement

Attitude Sensors

Let X, Y, Z be the three-axis accelerometer coordinate system, where the Z axis is parallel to the axis of the guide tool and points to the bottom of the guide tool; the X axis and Y axis are both on the cross section of the instrument, and X points to the reference direction of the instrument; The Y axis is perpendicular to the X axis, and the three axes are orthogonal to each other.

Figure 10:
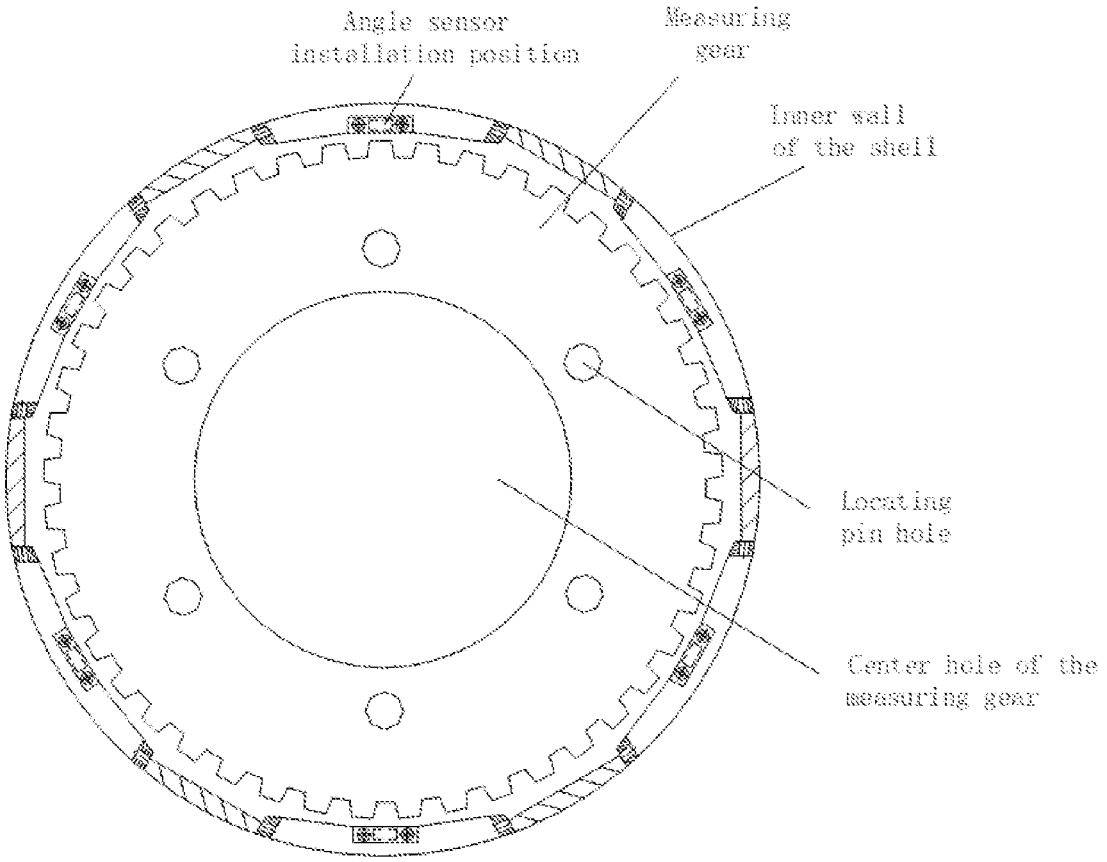
FIG. 10 is a schematic diagram of the installation of the angle transmission sensor of this disclosure.
Figure 11:
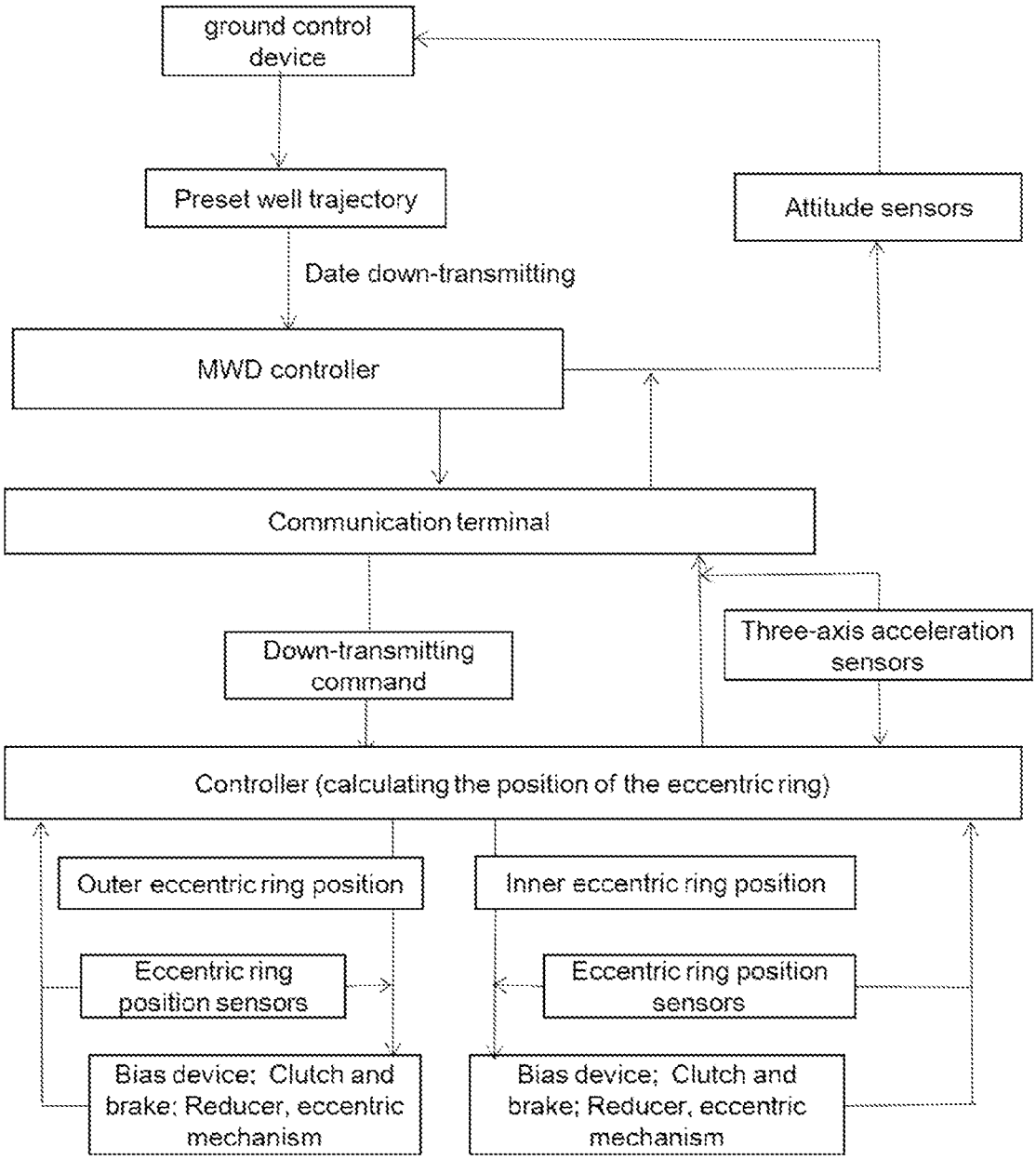
FIG. 11 is a schematic diagram of the measurement and control scheme of the pointing well trajectory control tool based on the drill pipe drive of this disclosure.

The tool face angle of the well trajectory control tool can be completed by a dedicated inclinometer sub: the calculation of the tool face angle in the inclinometer nipple only needs to measure the components in the three-axis direction of the tool coordinate system, according to these three acceleration components, the tool surface of the guiding tool can be calculated; therefore, the inclinometer sub is installed on the non-rotating shell; and because only one plane changes when the shell rotates, when the shell rotates, it is only needed to measure the component of the acceleration of gravity in the Z-axis direction, then the tool face angle can be obtained; the axis of the inclinometer pup is parallel to the high side of the tool's gravity direction (the initial state of the tool is not eccentric); the inclinometer pup is installed in the Z axis direction of the instrument coordinates (referring to FIG. 10).

Angle Sensors

The mechanical angle of the entire measuring gear is 360°, and there are 45 pairs of teeth, which are connected with the eccentric ring through the positioning pin hole and rotate with the eccentric ring; the spindle passes through the center hole of the measuring gear. The hole size is slightly larger than the spindle size because the spindle will bend during the offset process; the angle sensor is installed on the non-rotating shell, and the Hall sensor KM116/1 is used to realize the eccentric ring angle measurement. The chip contains high-performance magnetic steel, magnetoresistive sensor and IC. It uses IC to complete the signal conversion function. When the magnetic line of force is shielded (shunt) and cannot reach the Hall IC, the output of the Hall IC jumps to a low level at this time. The frequency of the output current signal is proportional to the measured speed. The change range of the current signal is 7~14 mA; because its peripheral circuit is relatively simple, it is easy to equip with a secondary meter to measure the speed; it has strong anti-interference ability and directionality, it is not sensitive to axial vibration, and its working temperature range is wide up to −40° C.~+150° C.; KMI16/1 sensor has the advantages of high sensitivity, wide measuring range, strong anti-interference ability, simple peripheral circuit, etc.; its volume is small, the maximum size is 8 mm×6 mm×21 mm, and it can be reliably fixed near the gear; In addition, there are electromagnetic interference (EMI) filters, voltage controllers and constant current sources inside the KMI16/1 sensor chip to ensure that its operating characteristics are not affected by external factors (referring to FIG. 10).

Inclination Measurement Scheme of Directional Well Trajectory Control Tool Based on Drill Pipe Drive The ground control device sets the well trajectory parameters according to the needs, and the data is down-transmitted to the MWD controller; the MWD controller transmits the down-transmitted instructions to the tool controller through the communication terminal; The tool controller needs to control the rotation of the eccentric ring according to the received instructions and the detection data of the sensors; the rotation angle of the eccentric ring is measured by the eccentric ring angle sensor, and the relative rotation angle of the inner ring of the eccentric ring and the outer ring of the eccentric ring is decomposed and calculated according to the tool face angle and offset set by the ground monitoring system. Achieving precise control depends on precise measurement, that is, the control and detection of the eccentric ring angle are closely related; the control sub-section is an important part of completing the closed-loop control of the downhole eccentric ring angle, and the control sub-section is expected to be downloaded from the ground monitoring system. The value of the eccentric ring rotation angle is stored in the control unit, and the relative rotation of the eccentric ring is realized by controlling the pull-in of the electromagnetic clutch to make the spindle bend in the specified tool surface to achieve the purpose of skew. When there is a deviation between the detected angle and the predetermined value, the deviation is used as a control parameter to control the electromagnetic clutch to achieve the purpose of controlling the rotation angle of the eccentric ring; during the drilling process, the shell of the tool will inevitably rotate and cause the deviation in the direction, the angle between the actual direction and the target direction is measured by the inclinometer sub-section installed on the shell to facilitate compensation and correction and reduce errors; the entire drilling system realizes double closed loops. Firstly, a small closed loop of the angle is realized, so that the rotation angle of the eccentric ring reaches the set angle; secondly, a large closed loop of underground engineering parameters is realized. Through the detection of well inclination, azimuth, and tool face angle, the eccentric ring rotation angle is recalculated, and the large closed loop is accurately controlled, and finally realizing the purpose of drilling according to the set trajectory.

The directional well trajectory control method based on drill pipe drive can achieve three-dimensional well trajectory control without frequent trips during drilling operations, and has a high penetration rate, good wellbore cleaning effect, well trajectory control accuracy, high flexibility, low tripping times, high borehole quality, high safety, etc., which is suitable for the development of special process wells such as medium-deep wells, ultra-deep wells, ultra-thin oil layer horizontal wells and unconventional oil and gas wells in China's complex oil and gas reservoirs. This method can also achieve precise control of well trajectory, and overcome the shortcomings of existing control methods that cannot achieve closed-loop control and cannot remove interference signals.

It is to be understood, however, that even though numerous characteristics and advantages of this disclosure have been set forth in the foregoing description, the disclosure is illustrative only, and changes may be made in detail, especially in matters of shape, size, and arrangement of parts within the principles of this disclosure to the full extent indicated by the broad general meaning of the terms in which the appended claims are expressed.

REFERENCE LIST

1 derrick
2 riser
3 sensors
4 controller
5 drill pipe
6 centralizer
7 MWD system
8 well trajectory control tool
9 drill
10 mandrel
11 upper dynamic sealing device
12 upper cantilever bearing
13 measurement and control short section
14 shell
15 upper coupling
16 outer ring electromagnetic clutch
17 outer ring harmonic drive
18 inner ring
19 outer ring
20 inner ring harmonic drive

21 inner ring electromagnetic clutch
22 lower end coupling
23 lower end ball bearing
24 lower end dynamic sealing device

What is claimed is:

1. A directional well trajectory control method based on drill pipe drive, including the following steps:

a) coding wellbore parameters by a method of dynamic incremental coding of steering parameters, and down-transmitting the wellbore parameters to a tool controller through drilling fluid pulses after completing coding;

b) after the tool controller receives the drilling fluid pulses, decoding the drilling fluid pulses through initial threshold determination, peak detection, and threshold update to obtain decoded well parameters;

c) according to a detection value of an attitude sensor and the decoded well parameters, calculating a tool face angle and an offset value;

d) calculating a rotation angle of an eccentric ring according to the offset value;

e) measuring an eccentric ring angle through an angle sensor, and controlling the opening and closing of an electromagnetic clutch according to a difference between a preset angle and the eccentric ring angle, so that the eccentric ring rotates to the rotation angle in steps c) and d) for closed-loop control of the rotation angle;

f) measuring an actual well inclination, azimuth, and tool face angle by the angle sensor and the attitude sensor, and then obtaining comparison results by comparing the actual well inclination, azimuth, and tool face angle with the wellbore parameters;

g) repeating steps c), d), and e) according to the comparison results to compensate a well trajectory and performing closed-loop control of the decoded well parameters and until the actual well inclination, azimuth, and tool face angle match with the wellbore parameters.

* * * * *